US009190730B2

(12) United States Patent
Someya

(10) Patent No.: US 9,190,730 B2
(45) Date of Patent: Nov. 17, 2015

(54) ANTENNA, RADIO RECEIVER AND METHOD FOR MANUFACTURING ANTENNA

(71) Applicant: CASIO COMPUTER CO., LTD., Tokyo (JP)

(72) Inventor: Kaoru Someya, Kiyose (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 291 days.

(21) Appl. No.: 13/677,602

(22) Filed: Nov. 15, 2012

(65) Prior Publication Data

US 2013/0127681 A1 May 23, 2013

(30) Foreign Application Priority Data

Nov. 18, 2011 (JP) ..... 2011-252158

(51) Int. Cl.
*H01Q 7/08* (2006.01)

(52) U.S. Cl.
CPC ..... *H01Q 7/08* (2013.01); *Y10T 29/49016* (2015.01)

(58) Field of Classification Search
CPC ..... H01Q 7/08
USPC ..... 343/788; 29/600
See application file for complete search history.

(56) References Cited

U.S. PATENT DOCUMENTS

| | | | | |
|---|---|---|---|---|
| 2006/0214866 | A1 | 9/2006 | Araki et al. | |
| 2010/0164823 | A1* | 7/2010 | Kubo et al. | 343/788 |
| 2010/0188307 | A1* | 7/2010 | Murata et al. | 343/788 |

FOREIGN PATENT DOCUMENTS

| | | | |
|---|---|---|---|
| CN | 1757136 | A | 4/2006 |
| CN | 101405665 | A | 4/2009 |
| JP | 2006-081140 | A | 3/2006 |
| JP | 2010178371 | A | 8/2010 |

OTHER PUBLICATIONS

Chinese Office Action dated Aug. 27, 2014, issued in counterpart Chinese Application No. 201210465338.5.
Japanese Office Action (and English translation thereof) dated May 26, 2015, issued in counterpart Japanese Application No. 2011-252158.

* cited by examiner

*Primary Examiner* — Dameon E Levi
*Assistant Examiner* — Andrea Lindgren Baltzell
(74) *Attorney, Agent, or Firm* — Holtz, Holtz, Goodman & Chick PC

(57) ABSTRACT

An antenna includes an elongated magnetic core, a secondary magnetic path member, a spacer and a coil. The secondary magnetic path member is disposed near the core, and forms a secondary magnetic path. The spacer is disposed between the core and the secondary magnetic path member so as to prevent the core and the secondary magnetic path member from being magnetically coupled. The coil is formed by winding a wire around the core in such a way as to bundle the core and the secondary magnetic path member together.

4 Claims, 8 Drawing Sheets

ANTENNA, RADIO RECEIVER AND METHOD FOR MANUFACTURING ANTENNA

BACKGROUND OF THE INVENTION

1. Field of the Invention

The present invention relates to an antenna, a radio receiver, and a method for manufacturing the antenna.

2. Description of the Related Art

Conventionally, there is known a radio receiver, such as a radio controlled timepiece, including an antenna which receives standard radio waves including time information. The radio receiver automatically corrects a current time on the basis of the time information.

As the antenna, which receives standard radio waves, of a radio controlled timepiece as an example of a radio receiver, there is an antenna often used, the antenna being constituted of a core made of a magnetic material sensitive to radio waves, such as an amorphous metal or ferrite, and a coil winding around the core.

In a case where a radio receiver is a radio controlled watch, in order to, for example, make the radio controlled watch sumptuous or improve design or durability of the radio controlled watch, a metal member may be used as an antenna case in which an antenna is housed, a cover of the antenna case, or the like.

In this case, namely, in the case where a metal member is used in a radio receiver, if an antenna is disposed near the metal member, the so-called eddy current is induced, and loss is caused thereby, which leads to decrease of sensitivity of the antenna to standard radio waves.

To deal with the problem, in Japanese Patent Application Laid-Open Publication No. 2006-81140, it is proposed, as a configuration of an antenna to prevent the sensitivity of the antenna from decreasing even if no enough distance can be secured between a metal member and the antenna, to dispose a gap-provided secondary magnetic path member on apart of a core in an magnetic sensor-type antenna having a primary magnetic path member constituted of (i) the core (magnetic core) made of a magnetic substance and (ii) a coil winding around the core, and receiving magnetic-filed components of electromagnetic waves with the primary magnetic path member.

However, in the antenna disclosed in Japanese Patent Application Laid-Open Publication No. 2006-81140, the member constituting the secondary magnetic path where a coil does not exist is disposed in such a way as to contact the member constituting the primary magnetic path where a coil exists, and magnetic flux entering the antenna from outside branches and flows into (passes through) the primary magnetic path and the secondary magnetic path. The magnetic flux flowing into the secondary magnetic path where a coil does not exist becomes loss, and the sensitivity of the antenna decreases.

BRIEF SUMMARY OF THE INVENTION

The present invention is made in view of the circumstances, and objects of the present invention include providing an antenna which is easily manufactured, and has excellent sensitivity to radio waves even if a metal member is disposed near the antenna, and providing a radio receiver including the antenna and a method for manufacturing the antenna.

In order to achieve at least one of the objects, according to a first aspect of the present invention, there is provided an antenna including: an elongated magnetic core; a secondary magnetic path member disposed near the core, and forming a secondary magnetic path; a spacer disposed between the core and the secondary magnetic path member so as to prevent the core and the secondary magnetic path member from being magnetically coupled; and a coil formed by winding a wire around the core in such a way as to bundle the core and the secondary magnetic path member together.

In order to achieve at least one of the objects, according to a second aspect of the present invention, there is provided a radio receiver including: (i) an antenna including: an elongated magnetic core; a secondary magnetic path member disposed near the core, and forming a secondary magnetic path; a spacer disposed between the core and the secondary magnetic path member so as to prevent the core and the secondary magnetic path member from being magnetically coupled; and a coil formed by winding a wire around the core in such a way as to bundle the core and the secondary magnetic path member together; and (ii) a metallic antenna case in which the antenna is housed.

In order to achieve at least one of the objects, according to a third aspect of the present invention, there is provided a method for manufacturing an antenna including: forming an elongated magnetic core; and forming a coil by winding a wire around the core in such a way as to bundle the core and a secondary magnetic path member together, the secondary magnetic path member forming a secondary magnetic path, in a state in which the secondary magnetic path member is disposed near the core with a spacer disposed between the core and the secondary magnetic path member so as to prevent the core and the secondary magnetic path member from being magnetically coupled.

DETAILED DESCRIPTION OF THE INVENTION

First Embodiment

An antenna and a radio receiver including the antenna in accordance with a first embodiment of the present invention are described referring to FIGS. 1 to 9.

In the embodiment, a radio controlled watch in which an antenna is installed is described as a radio receiver.

The present invention is not limited to the following embodiments or the accompanying drawings.

Figure 1:
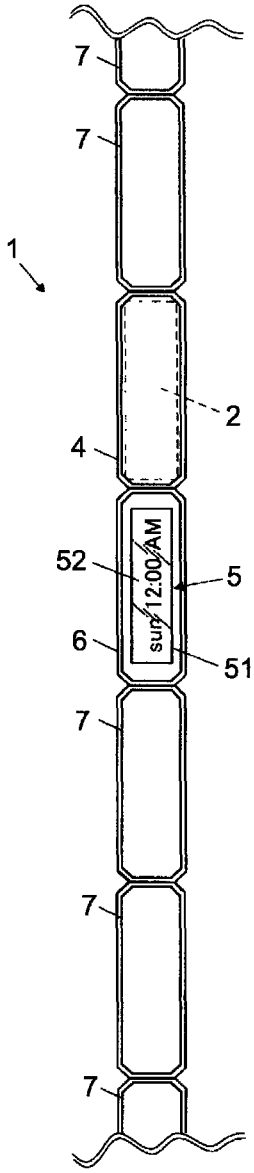
FIG. 1 is a front view schematically showing a configuration of a radio controlled watch as an example of a radio receiver of the present invention.

FIG. 1 is a front view of a radio controlled watch (radio receiver) in accordance with the first embodiment.

As shown in FIG. 1, a radio controlled watch 1 includes an antenna 2 and an antenna case 4 in which the antenna 2 is housed.

In the embodiment, the radio controlled watch 1 also includes a watch main body 5, a watch case 6, and band pieces 7. A display device 51, electronic components (not shown) including a receiving circuit to receive radio waves with the antenna 2, and the like are installed in the watch main body 5. The display device 51 displays time or the like. The watch main body 5 is housed in the watch case 6. The band pieces 7 are connected with the watch case 6 and the antenna case 4 so as to constitute a watch band of the radio controlled watch 1.

On the back faces of the antenna case 4, the watch case 6 and the band pieces 7, not-shown connecting parts are disposed so that the antenna case 4, the watch case 6 and the band pieces 7 are connected to each other so as to be in the shape of a chain.

It is preferable that the antenna case 4 in which the antenna 2 is housed is disposed next to or near the watch case 6 in which the watch main body 5 is housed, but the position of the antenna case 4 is not particularly limited thereto.

As shown in FIG. 1, in the radio controlled watch 1 of the embodiment, the antenna case 4, the watch case 6 and the band pieces 7 are formed to be almost the same shape and size.

The antenna case 4, the watch case 6 and the band pieces 7 are made of, for example, an electric conductive material such as a metal material, for example, stainless steel or titanium, and formed to be almost rectangular parallelepipeds.

It is unnecessary that the antenna case 4, the watch case 6 and the band pieces 7 are made of a same material. The antenna case 4, the watch case 6 and the band pieces 7 may be made of different materials. For example, only the watch case 6 may be made of gold, platinum or a combination thereof, and the antenna case 4 and the band pieces 7 may be made of another material.

The antenna case 4 has a hollow structure in which one face of the antenna case 4, such as the back face (i.e. the side which touches a wrist when a user wears the radio controlled watch 1 on his/her wrist), is provided with an opening part (not shown). This hollow part is a space in which the antenna 2 is housed.

A cover (not shown) is fitted to the opening part with a waterproof ring (not shown) disposed between the cover and the opening part. Material of the cover is not particularly limited, but it is preferable that the cover is made of material which allows penetration of radio waves, such as resin.

The direction or orientation in which the antenna 2 is housed in the antenna case 4 is not particularly limited, and can be appropriately changed in accordance with a design of the radio controlled watch 1 or the like.

For example, the antenna 2 may be placed in the antenna case 4 almost parallel to the opening face (the face having the opening part) of the antenna case 4, or placed in the antenna case 4 almost parallel to an inter lateral face of the antenna case 4.

It is preferable that the antenna 2 is disposed in such a way as not to touch the inner surface of the antenna case 4.

Figure 2:
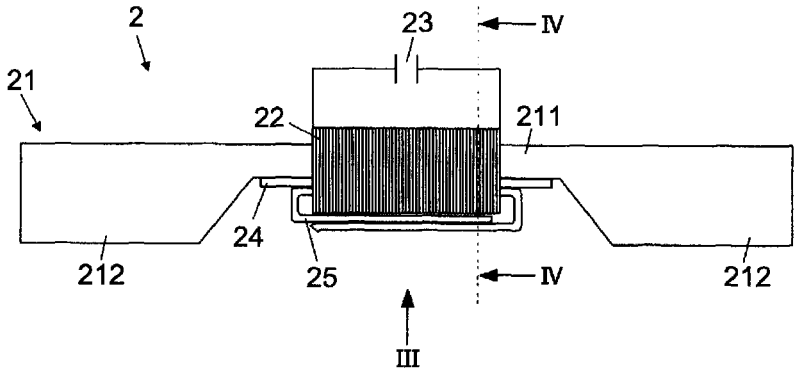
FIG. 2 is a plan view of an antenna in accordance with a first embodiment of the present invention.
Figure 3:
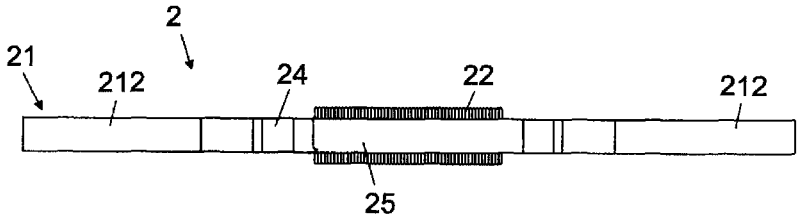
FIG. 3 is an elevation view of the antenna viewed from the arrow III of FIG. 2.
Figure 4:
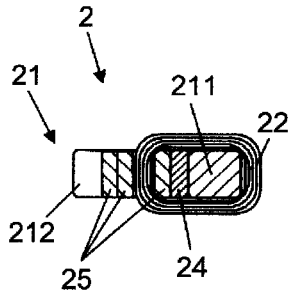
FIG. 4 is a cross-sectional view of the antenna taken along the line IV-IV of FIG. 2.

FIG. 2 is a plan view of the antenna 2 in the embodiment. FIG. 3 is an elevation view of the antenna 2 viewed from the arrow III of FIG. 2. FIG. 4 is a cross-sectional view of the antenna 2 taken along the line IV-IV of FIG. 2.

As shown in FIGS. 2 to 4, in the embodiment, the antenna 2 housed in the antenna case 4 includes a core 21 formed in the shape of an elongated plate, a coil 22 formed on the core 21, and a secondary magnetic path member 25 disposed to the core 21 with a spacer 24 disposed between the core 21 and the secondary magnetic path member 25.

The core 21 is made of a magnetic material, such as an amorphous alloy, a nanocrystalline magnetic alloy such as an Fe—Cu—Nb—Si—B alloy, an Fe—Si alloy, ferrite, or permalloy. As shown in FIG. 2, the core 21 includes a linear part 211 and a pair of protruding parts 212. The linear part 211 extends in a longer direction of the antenna 2. The protruding parts 212 respectively protrude from the ends (lateral ends) of the linear part 211 to one side in a direction intersecting at right angles to an extending direction in which the linear part 211 extends.

In the embodiment, with respect to each of the protruding parts 212, of the lateral ends of the protruding part 212, the lateral end close to the linear part 211 is obliquely cut from the middle so that the protruding part 212 becomes narrower toward an end in a protruding direction in which the protruding part 211 protrudes.

Consequently, when a wire is wounded around the linear part 211 to form the coil 22, the protruding parts 212 do not obstruct the winding operation, and accordingly the coil 22 can be easily formed.

The length, width, and shape of the linear part 211 and the shape, size, and the like of the protruding parts 212 are not limited to these exemplified herein.

Further, the material of the core 21 is not limited to an amorphous alloy, a nanocrystalline magnetic alloy such as an Fe—Cu—Nb—Si—B alloy, an Fe—Si alloy, ferrite, or permalloy. As long as the material is a magnetic material which can be processed to be the shape of the core 21, another material can be used.

Further, a method for forming the core 21 is not particularly limited. For example, soft magnetic metal foils/leaves made of an amorphous alloy, a nanocrystalline magnetic alloy such as an Fe—Cu—Nb—Si—B alloy, an Fe—Si alloy or the like may be placed on top of each other so that a thin plate is formed as the core 21.

Alternatively, powder of a magnetic material such as an amorphous alloy, ferrite, or permalloy may be hardened so that the core 21 is formed as a single unit.

Alternatively, permalloy or the like may be processed or molded so that the core 21 is formed.

In the embodiment, as shown in FIGS. 2 to 4, the spacer 24 and the secondary magnetic path member 25 are disposed near the linear part 211 of the core 21 on the side of the linear part 211, the side to which the protruding parts 212 protrude. The spacer 24 is made of material having low magnetic permeability, such as resin. The secondary magnetic path member 25 is made of a magnetic material, and forms a secondary magnetic path.

In the embodiment, the secondary magnetic path member 25 forms a closed magnetic path as the secondary magnetic path by the ends of the secondary magnetic path member 25 in the shape of a thin plate (sheet) being magnetically coupled (joined). The secondary magnetic path member 25 is disposed parallel to the core 21 with the spacer 24 between the core 21 and the secondary magnetic path member 25.

The method for coupling the ends of the secondary magnetic path member 25 is not particularly limited. For example, the ends of the secondary magnetic path member 25 may be coupled by using an adhesive including a magnetic material or the like so that the ends thereof adhere to each other, and accordingly to be fixed to each other (adhesive fixing).

Thus, the secondary magnetic path member 25 is disposed in such a way as to enclose the coil 22, and forms a looped magnetic path which allows magnetic flux from the coil 22 to circle.

By making an area where the ends of the secondary magnetic path member 25 overlaps with each other sufficiently wide, a gap between the ends (joining parts) can be made small to the extent that the gap can be ignored. Consequently, magnetic resistance can be small, so that the magnetic flux can more easily pass through the secondary magnetic path member (i.e. secondary magnetic path).

The secondary magnetic path member 25 is made of a magnetic material which has excellent flexibility, such as permalloy, so as not to be broken, cracked or the like when bending is performed on the secondary magnetic path member 25.

The secondary magnetic path member 25 may be formed by one plate or a plurality of thin plates being placed on top of each other.

The spacer 24 is disposed between the core 21 and the secondary magnetic path member 25 so as to prevent the core 21 and the secondary magnetic path member 25 from being magnetically coupled.

As long as the spacer 24 can magnetically insulate the core 21 from the secondary magnetic path member 25, the shape, size, thickness, material and the like of the spacer 24 are not particularly limited.

The spacer 24 may be an ultrathin film. For example, the spacer 24 may be a double-sided adhesive tape made of a resin material.

In the case where the spacer 24 is a double-sided adhesive tape, the core 21 and the secondary magnetic path member 25 can be easily taped to be fixed.

The coil 22 is formed by winding a wire around the linear part 211 of the core 21 for a predetermined number of times in such a way as to bundle the core 21 and the secondary magnetic path member 25 together.

In the embodiment, as shown in FIGS. 2 to 4, the secondary magnetic path member 25 being a thin plate is disposed near the linear part 211 of the core 21 with the spacer 24 being a film between the linear part 211 of the core 21 and the secondary magnetic path member 25. The coil 22 winds around the linear part 211 of the core 21 in such a way as to bundle the core 21, the spacer 24 and the secondary magnetic path member 25 together.

The number of times that a wire is wounded to form the coil 22 is not particularly limited, and appropriately set in accordance with, for example, a frequency of a radio wave received by the antenna 2.

A capacitor 23 is connected to the coil 22, so that a resonance circuit is formed by the coil 22 and the capacitor 23 in the antenna 2.

A resonant frequency of the resonance circuit is appropriately set in accordance with a use of the antenna 2 by adjusting the number of times that a wire is wounded to form the coil 22 or a capacitance of the capacitor 23, for example.

In the embodiment, the resonant frequency of the antenna 2 is set to 40 kHz or 60 kHz which is a transmit frequency of the Japan standard radio wave.

Figure 5:
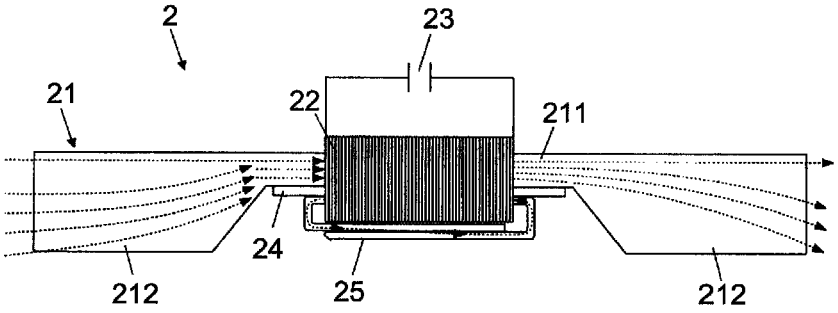
FIG. 5 is a plan view showing magnetic flux passing through the antenna shown in FIG. 2.

FIG. 5 schematically shows magnetic flux passing through the antenna 2 of the embodiment.

FIG. 5 only shows magnetic flux entering the antenna 2 from the left side of the antenna 2, but, in reality, magnetic flux also enters the antenna 2 from the right side of the antenna 2 so as to pass through the antenna 2.

In the embodiment, the spacer 24 is disposed between the core 21, which is provided with the coil 22, thereby forming a primary magnetic path, and the secondary magnetic path member 25, which forms the secondary magnetic path, so that magnetic coupling between the core 21 and the secondary magnetic path member 25 is weak.

In this case, as shown in FIG. 5, most of the magnetic flux entering the antenna 2 from outside passes through the primary magnetic path formed by the core 21 so as to flow into the coil 22, and consequently the magnetic flux hardly flows into the secondary magnetic path formed by the secondary magnetic path member 25 which is insulated from the core 21 by the spacer 24.

Accordingly, the magnetic flux entering the antenna 2 from outside can be prevented from flowing into the secondary magnetic path and being loss instead of flowing into the coil 22.

Further, most of the magnetic flux from the coil 22 generated by resonance passes through the secondary magnetic path member 25, which is disposed in such a way as to enclose the coil 22, and has sufficiently low magnetic resistance, so as to circle (circuit). Accordingly, the magnetic flux can be prevented from leaking outside the antenna 2.

Accordingly, even if a metal member such as the antenna case 4 is disposed near the antenna 2, there is almost no magnetic flux which leaks to the side where the metal member is disposed, and hence loss or the like caused by an eddy current induced is hardly caused.

Therefore, the antenna 2 can keep excellent sensitivity to radio waves, and shows a high Q factor.

Figure 6:
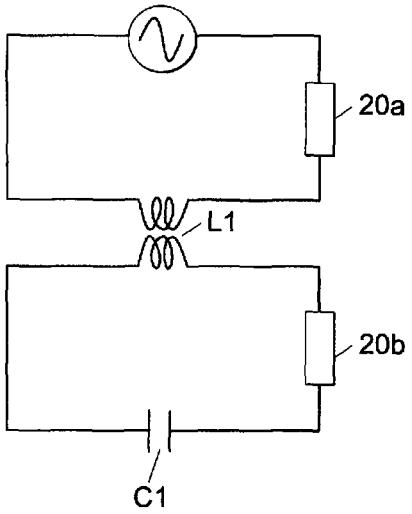
FIG. 6 is a circuit diagram equivalently showing the magnetic flux shown in FIG. 5.

FIG. 6 is a circuit diagram equivalently showing the magnetic flux passing through the antenna 2 of the embodiment, regarding the magnetic flux entering the antenna 2 from outside as a constant current source.

An "L1" and a "C1" in FIG. 6 correspond to the coil 22 and the capacitor 23 in FIG. 5, respectively.

A magnetic resistor 20*a* and a magnetic resistor 20*b* in FIG. 6 correspond to magnetic resistance of the primary magnetic path of the antenna 2 and magnetic resistance of the secondary magnetic path of the antenna 2, respectively.

As shown in FIG. 6, in the case where the magnetic flux entering the antenna 2 from outside is regarded as a constant current source, a current flows into the coil L1.

Then, there is a virtual coil which is insulated from the primary magnetic path having the magnetic resistor 20*a*, and has the same inductance as that of the primary magnetic path and a sufficiently high coupling degree. A resonance-type closed circuit is formed by the virtual coil in cooperation with the magnetic resistor 20*b* of the secondary magnetic path.

The resonance-type closed circuit is a closed circuit (closed magnetic path) through which a current (magnetic flux) circles (loops). The current is a current generated by resonance when a current (magnetic flux) enters a coil.

That is, in the antenna 2 of the embodiment, as shown in FIG. 5, a resonance-type closed circuit is formed at the time of resonance in the secondary magnetic path, which is formed by the secondary magnetic path member 25, and the magnetic flux generated by resonance flows (circles) not only into the primary magnetic path but also into the looped secondary magnetic path formed by the secondary magnetic path member 25.

To increase electromotive force of the coil 22, each of the magnetic resistors 20*a* and 20*b* of the magnetic substances (i.e. the core 21 and the secondary magnetic path member 25) be formed in such a way that the magnetic flux easily passes through the magnetic resistor 20*a* or 20*b*. For that, it is preferable to configure, for example, the secondary magnetic path member 25 as a closed magnetic path which has a gap as small as possible, and accordingly has small magnetic resistance.

Accordingly, the sensitivity of the antenna 2 to radio waves can be high because the Q factor of the resonance circuit formed by the coil 22 and the capacitor 23 (i.e. the resonance circuit formed in the primary magnetic path and the resonance-type closed circuit formed in the secondary magnetic path) becomes high.

Figure 7:
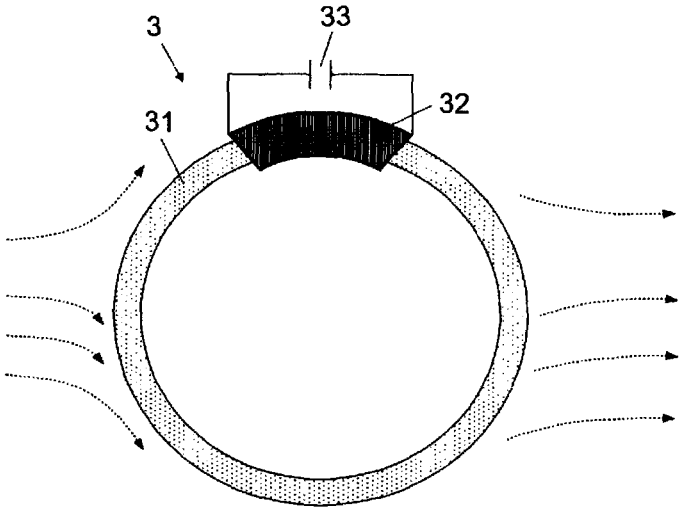
FIG. 7 is a plan view showing magnetic flux passing through a ring antenna.

On the other hand, as shown in FIG. 7, in the case of a ring antenna 3 having a secondary magnetic path which is not separated from a primary magnetic path, magnetic flux flowing into a coil 32 which forms a resonance circuit with a capacitor 32 decreases because a magnetic impedance increases.

Then, it is considered that the magnetic flux passes through a magnetic substance part (secondary magnetic path, i.e. the lower part of a core 31 of the ring antenna 3 in FIG. 7) where a resonance circuit is not formed, rather by the decreased amount.

Figure 8:
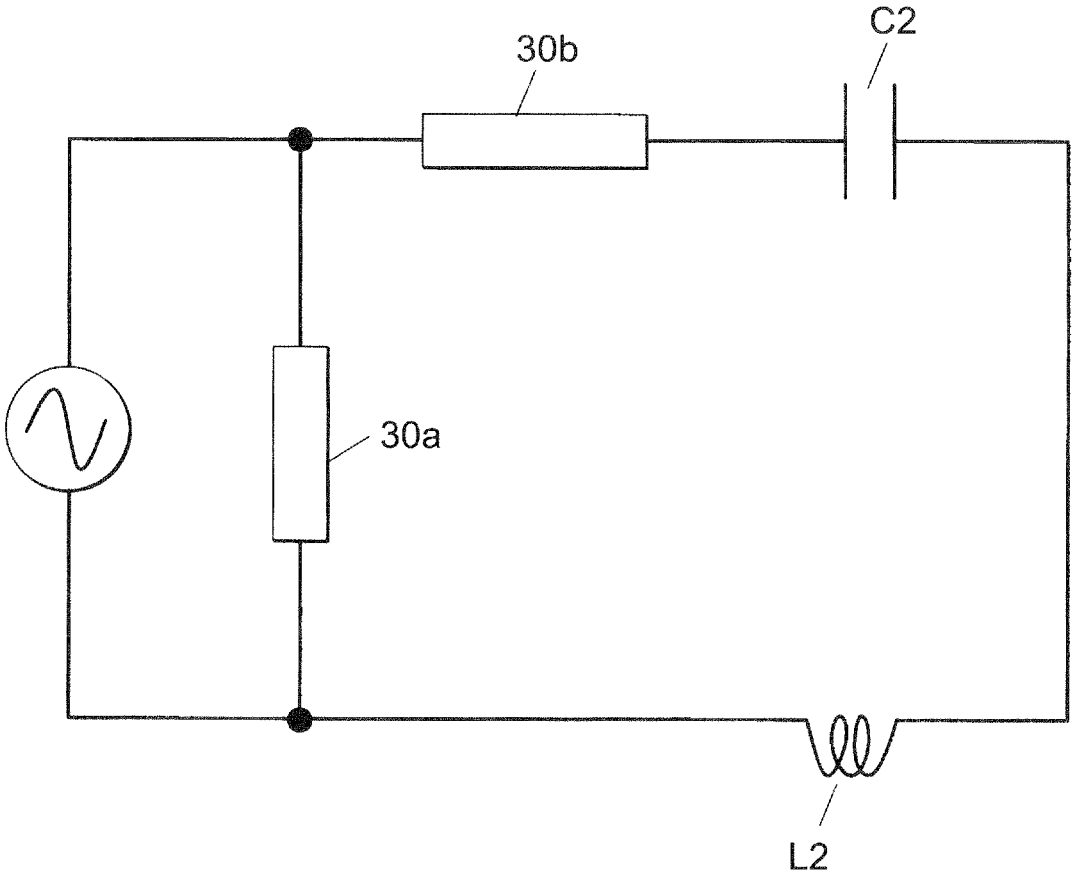
FIG. 8 is a circuit diagram equivalently showing the magnetic flux shown in FIG. 7.

FIG. 8 is a circuit diagram equivalently showing the magnetic flux passing through the ring antenna 3, regarding the magnetic flux entering the ring antenna 3 from outside as a constant current source.

An "L2" and a "C2" in FIG. 8 correspond to the coil 32 and the capacitor 33 in FIG. 7, respectively.

A magnetic resistor 30*a* and a magnetic resistor 30*b* in FIG. 8 correspond to magnetic resistance of a primary magnetic path of the ring antenna 3 and magnetic resistance of the secondary magnetic path of the ring antenna 3, respectively.

As shown in FIG. 8, in the case where the magnetic flux entering the ring antenna 3 from outside is regarded as a constant current source, a current branches into a current which flows into the resonance circuit and a current which flows into the secondary magnetic path part, and the magnetic resistance (the magnetic resistors 30*a* and 30*b*) exists in the circuits (the resonance circuit and the secondary magnetic path part).

That is, in the ring antenna 3, as shown in FIG. 7, the magnetic flux entering the ring antenna 3 from outside branches, and flows into the primary magnetic path and the secondary magnetic path.

Because the magnetic resistor 30*b* of the secondary magnetic path is smaller than the magnetic resistor 30*a* of the primary magnetic path, the Q factor of the resonance circuit formed by the coil 32 and the capacitor 33 increases, but leakage of the magnetic flux to the secondary magnetic path also increases.

The leakage of the magnetic flux to the secondary magnetic path becomes loss, so that the sensitivity of the ring antenna 3 decreases by the amount of loss.

In order to deal with the loss, it is considered to provide a gap-provided ring-shaped secondary magnetic path so as to increase the magnetic resistance, thereby optimizing the magnetic flux flowing into the resonance circuit and optimizing the Q factor.

However, if the primary magnetic path and the secondary magnetic path are not insulated from each other, the magnetic flux of the standard radio wave or the like entering an antenna from outside cannot be prevented from flowing into the secondary magnetic path. Consequently, loss is caused, so that the Q factor of the resonance circuit does not increase much.

The watch case 6 has a hollow structure in which a front-face opening part and a back-face opening part are provided so that the front (upper) face and the back (lower) face of the watch case 6 are open. This hollow part is a space in which the watch main body 5 is housed.

A windshield 52 made of glass or the like is fitted to the front-face opening part of the front face of the watch case 6 (i.e. the side visually confirmed by a user when the user wears the radio controlled watch 1 on his/her wrist).

Further, a not-shown back-face cover is fitted to the back-face opening part of the back side of the watch case 6 (i.e. the side which touches a wrist of a user when the user wears the radio controlled watch 1 on his/her wrist) with a waterproof ring (not shown) disposed between the back-face cover and the back face opening part.

Material of the back-face cover is not particularly limited, but it is preferable that the back-face cover is made of the same material as the material of the watch case 6, the antenna case 4, and the band pieces 7 in terms of external appearance of the radio controlled watch 1. The material may be metal such as stainless steel or titanium, or may be another material.

The watch main body 5 housed in the watch case 6 includes the display device 51 which displays time or the like, and a circuit board (not shown) on which various circuits constituting a not-shown control device operating various functional units of the radio controlled watch 1, electronic components, and the like are mounted.

The display device 51 is a display unit constituted of a liquid crystal display panel or the like.

A configuration of the liquid crystal display panel constituting the display device 51, contents displayed thereon and the like are not particularly limited.

The display device 51 is not limited to a display device constituted of a liquid crystal display panel, and hence may be constituted of an organic EL (Electro-Luminescence) or the like.

In the embodiment, as shown in FIG. 1, a current time and a current day of a week are displayed on a display screen of the display device 51. However, the contents displayed on the display device 51 are not limited thereto.

The control device is a computer including a CPU (Central Processing Unit), and a ROM (Read Only Memory) and a RAM (Random Access Memory) which constitute a storage unit (all not shown).

The control device functionally includes a display control unit to operate and control the display device 51, a radio receiving unit to receive radio waves with the antenna 2, and a time measurement unit, for example, to correct a current time on the basis of the standard radio wave received by the antenna 2 (all not shown).

The display control, radio reception control, time correction control and the like performed by the control device are the same as those performed in a conventional radio receiver, and hence description thereof is omitted.

In the embodiment, the antenna 2 housed in the antenna case 4 is electrically connected to the circuit board of the watch main body 5 housed in the watch case 6. The radio wave received by the antenna 2 is transmitted to the control device of the watch main body 5 as reception signals. The time correction and the like based on these reception signals are performed as needed.

Next, a method for manufacturing the antenna 2 in the embodiment and operation of the antenna 2 are described referring to FIGS. 9A to 9D.

Figure 9A:
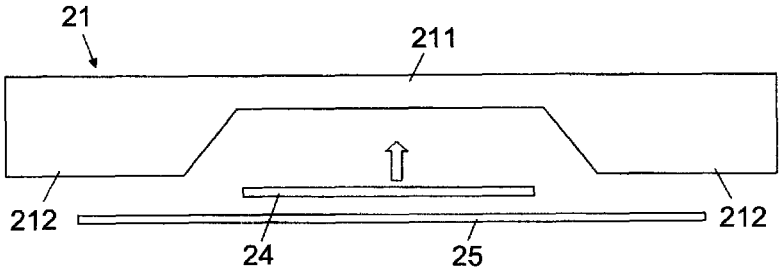
FIG. 9A is a plan view showing a plate member forming step (a core forming step) in a manufacturing process of the antenna shown in FIG. 2.

As shown in FIG. 9A, first, the core 21 is formed, the core 21 which is made of a magnetic material such as an amorphous alloy, a nanocrystalline magnetic alloy such as an Fe—Cu—Nb—Si—B alloy, an Fe—Si alloy, ferrite, or permalloy, and includes the linear part 211 and the protruding parts 212 respectively protruding from the ends (lateral ends) of the linear part 211 to one side in a direction intersecting at right angles to the extending direction in which the linear part 211 extends (a core forming step).

Then, the secondary magnetic path member 25 being a thin plate is disposed near the linear part 211 of the core 21 on the side of the linear part 211, the side to which the protruding parts 212 protrude, with the spacer 24 being a film between the linear part 211 of the core 21 and the secondary magnetic path member 25.

Figure 9B:
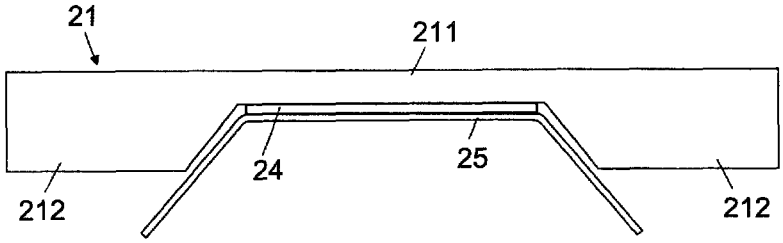
FIG. 9B is a plan view showing a coil forming step in the manufacturing processing of the antenna shown in FIG. 2.
Figure 9C:
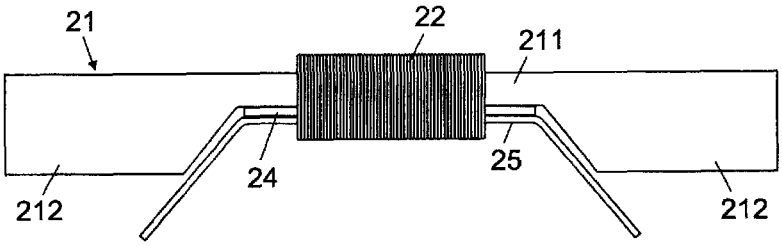
FIG. 9C is a plan view showing the coil forming step in the manufacturing process of the antenna shown in FIG. 2.

Next, as shown in FIGS. 9B and 9C, the coil 22 is formed by winding a wire around the linear part 211 of the core 21 in such a way as to bundle the core 21 and the secondary magnetic path member 25 together in a state in which the spacer 24, which prevents the core 21 and the secondary magnetic path member 25 from being magnetically coupled, is disposed between the core 21 and the secondary magnetic path member 25 (a coil forming step).

Figure 9D:
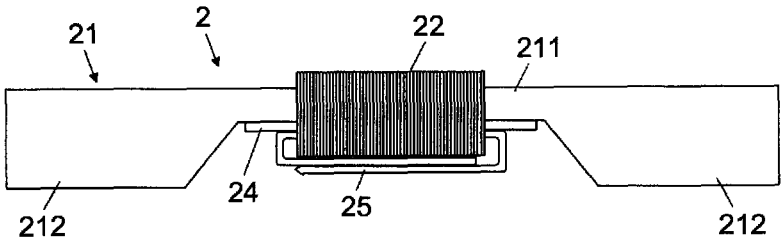
FIG. 9D is a plan view showing a secondary magnetic path member coupling step in the manufacturing process of the antenna shown in FIG. 2.

After winding a wire around the linear part 211 of the core 21 in such away as to bundle the core 21 and the secondary magnetic path member 25 together, as shown in FIG. 9D, the ends of the secondary magnetic path member 25, which is disposed parallel to the core 21 with the spacer 24 between the secondary magnetic path member 25 and the core 21, are magnetically coupled by being placed on top of each other, and adhering to each other so as to be fixed (adhesive fixing).

Thus, the closed magnetic path is formed as the secondary magnetic path (a secondary magnetic path member coupling step), whereby the antenna 2 is manufactured.

The manufactured antenna 2 is housed in the antenna case 4, and the antenna case 4 and the watch case 6 in which the watch main body 5 is housed are connected to each other so that the antenna 2 and the circuit board and the like in the watch main body 5 are eclectically connected to each other.

Further, the band pieces 7 are connected to the antenna case 4 and the watch case 6, whereby the bracelet type radio controlled watch 1 is manufactured.

To perform time correction on the basis of the standard radio wave, the standard radio wave is received by the antenna 2.

At the time, as shown in FIG. 5, most of the magnetic flux entering the antenna 2 from outside flows to a narrow part of the core 21 (i.e. the linear part 211), and accordingly flows into the coil 22 disposed on the linear part 211. When the magnetic flux flows into the coil 22, electromotive force is generated, and the energy is accumulated in the capacitor 23.

Then, the energy is discharged from the capacitor 23, and passes through the coil 22, so that the magnetic flux is generated therefrom.

Most of the magnetic flux generated by this resonance circles along the looped secondary magnetic path formed by the secondary magnetic path member 25, and consequently the magnetic flux hardly leaks outside the antenna 2.

Accordingly, even if a metal member such as the antenna case 4 is disposed near the antenna 2, there is almost no magnetic flux leaking to the side where the metal member is disposed, and hence loss caused by an eddy current induced is prevented from being caused, and the antenna 2 can keep excellent sensitivity to radio waves.

The reception signals based on the standard radio wave received by the antenna 2 are transmitted to the control device, and the control device performs amplification, analysis and the like on the reception signals so as to read the time information.

The control device corrects a current time on the basis of the time information, and displays the corrected time on the display screen of the display device 51.

As described above, in the embodiment, the secondary magnetic path member 25 is disposed near the core 21 with the spacer 24 between the secondary magnetic path member 25 and the core 21, and then forms the coil 22 by winding a wire around the core 21 in such a way as to bundle the core 21 and the secondary magnetic path member 25 together. The secondary magnetic path member 25 forms the secondary magnetic path, and the spacer 24 prevents the core 21 and the secondary magnetic path member 25 from being magnetically coupled.

Hence, the magnetic flux entering the core 21 from outside hardly flows into the secondary magnetic path, which is insulated from the core 21 by the spacer 24, and flows into the primary magnetic path where the coil 22 is formed. In addition, the magnetic flux generated by resonance circles along the primary magnetic path formed by the core 21 and the looped secondary magnetic path formed by the secondary magnetic path member 25, and accordingly hardly leaks outside the antenna 2.

Accordingly, even if a metal member is disposed near the antenna 2, loss caused by the magnetic flux flowing toward the metal member can be prevented from being caused. Accordingly, excellent sensitivity to radio waves can be realized.

That is, sufficient sensitivity to radio waves can be obtained by the small antenna 2.

Further, because a metal member such as the antenna case 4 can be disposed even very near the antenna 2, a radio receiver including the antenna 2, such as the radio controlled watch 1, can be miniaturized.

Further, after winding a wire around the core 21 in such a way as to bundle the core 21 and the secondary magnetic path member 25 being a thin plate together to form the coil 22, the ends of the secondary magnetic path member 25 are placed on top of each other so as to be magnetically coupled, whereby the closed magnetic path is formed as the secondary magnetic path.

Consequently, a wire is automatically wounded by a machine so as to form the coil 22, and accordingly the antenna 2 can be easily and efficiently manufactured.

Further, in the embodiment, the antenna case 4, the watch case 6 and the band pieces 7 are all the same in size and shape. Accordingly, an excellently designed bracelet type watch can be realized.

Second Embodiment

Figure 10:
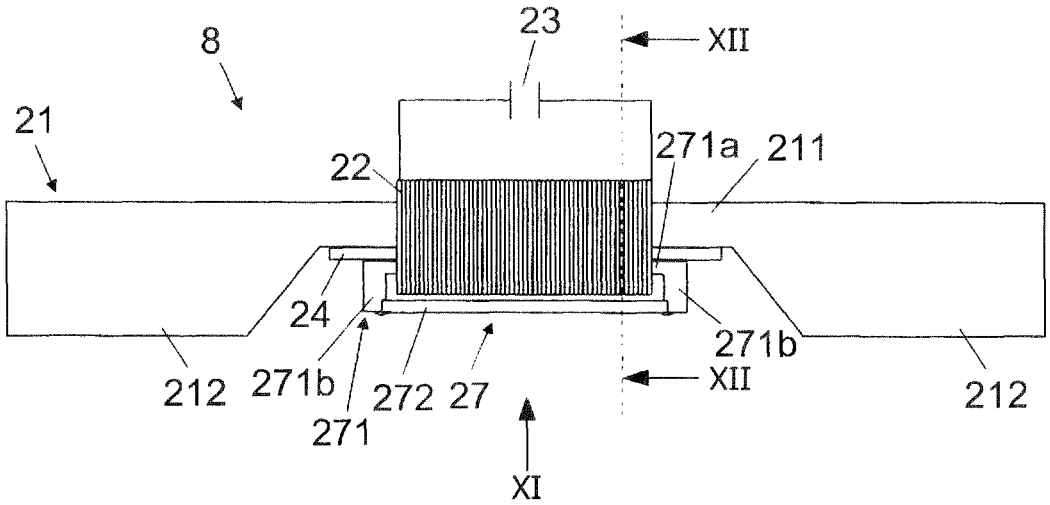
FIG. 10 is a plan view of an antenna in accordance with a second embodiment of the present invention.
Figure 11:
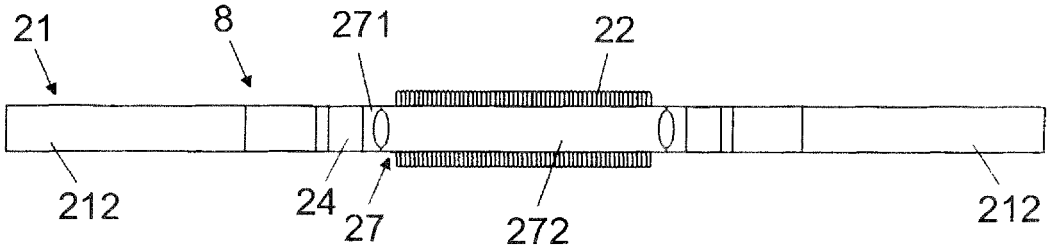
FIG. 11 is an elevation view of the antenna viewed from the arrow XI of FIG. 10.
Figure 12:
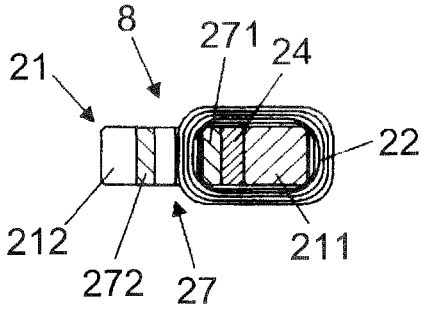
FIG. 12 is a cross-sectional view of the antenna taken along the line XII-XII of FIG. 10.

Next, an antenna, a radio receiver including the antenna, and a method for manufacturing the antenna in accordance with a second embodiment of the present invention are described referring to FIGS. 10 to 12.

In the second embodiment, only the configuration of a secondary magnetic path member is different from that in the first embodiment. Hence, in the following, points different from the first embodiment are described mainly.

FIG. 10 is a plan view of an antenna 8 in accordance with the second embodiment.

FIG. 11 is an elevation view of the antenna 8 viewed from the arrow XI of FIG. 10.

FIG. 12 is a cross-sectional view of the antenna 8 taken along the line XII-XII of FIG. 10.

A radio receiver in the second embodiment is, like the first embodiment, a radio controlled watch including the antenna 8 and the antenna case 4 which is made of a metal material and in which the antenna 8 is housed. The radio controlled watch corrects a current time on the basis of the standard radio wave received by the antenna 8, and displays the corrected current time on the display device 51.

As shown in FIGS. 10 to 12, in the second embodiment, the antenna 8 includes the core 21, the coil 22 and the spacer 24, which are the same as those in the first embodiment.

In the embodiment, a secondary magnetic path member 27 includes a U-shaped base member 271 and a coupling member 272. The base member 271 includes a linear part 271*a* and a pair of projecting parts 271*b* which project from the linear part 271*a* in one direction. The coupling member 272 magnetically couples the projecting parts 271*b* of the base member 271 so as to form a closed magnetic path as a secondary magnetic path.

The base member 271 and the coupling member 272 are made of a magnetic material, such as an amorphous alloy, a nanocrystalline magnetic alloy such as an Fe—Cu—Nb—Si—B alloy, an Fe—Si alloy, ferrite, or permalloy.

As the material of the base member 271 and the coupling member 272, as long as the material is a magnetic material which can be processed to be the shape of the base member 271 and the shape of the coupling member 272, another material can be used.

Further, a method for forming the base member 271 and the coupling member 272 is not particularly limited. For example, soft magnetic metal foils/leaves made of an amorphous alloy, a nanocrystalline magnetic alloy such as an Fe—Cu—Nb—Si—B alloy, an Fe—Si alloy or the like may be placed on top of each other so that thin plates are formed as the base member 271 and the coupling member 272.

Alternatively, powder of a magnetic material such as an amorphous alloy, ferrite, or permalloy may be hardened so that each of the base member 271 and the coupling member 272 is formed as a single unit. Alternatively, permalloy or the like may be processed or molded so that the base member 271 and the coupling member 272 are formed.

The coupling member 272 is attached to the projecting parts 271*b* of the base member 271 by adhesive fixing with an adhesive or the like.

As the adhesive, an adhesive into which a magnetic substance is mixed is used, for example.

The method for attaching the coupling member 272 to the projecting parts 271*b* is not limited to adhesive fixing.

Further, in the case of adhesive fixing, kinds of adhesive are not particularly limited.

Configurations of the other components are the same as those in the first embodiment. Hence, the components are denoted by the same references as those in the first embodiment, and discretion thereof is omitted.

Next, the method for manufacturing the antenna 8 in the embodiment and operation of the antenna 8 are described.

First, like the first embodiment, the core 21 is formed, the core 21 which is made of a magnetic material such as an amorphous alloy, a nanocrystalline magnetic alloy such as an Fe—Cu—Nb—Si—B alloy, an Fe—Si alloy, ferrite, or permalloy, and includes the linear part 211 and the protruding parts 212 respectively protruding from the ends (lateral ends) of the linear part 211 to one side in a direction intersecting at right angles to the extending direction in which the linear part 211 extends (a core forming step).

Then, the U-shaped base member 271 is disposed near the linear part 211 of the core 21 on the side of the linear part 211, the side to which the protruding parts 212 protrude, with the spacer 24 being a film between the core 21 and the base member 271.

Next, the coil 22 is formed by winding a wire around the linear part 211 of the core 21 in such a way as to bundle the core 21 and the secondary magnetic path member 27 (the base member 271) together in a state in which the spacer 24, which prevents the core 21 and the secondary magnetic path member 27 from being magnetically coupled, is disposed between the core 21 and the base member 271 of the secondary magnetic path member 27 (a coil forming step).

After winding a wire around the linear part 211 of the core 21 in such away as to bundle the core 21 and the secondary magnetic path member 27 (the base member 271) together, the coupling member 272 is attached to the base member 271 by adhesive fixing or the like (a secondary magnetic path coupling step). The base member 271 is disposed parallel to the core 21 with the spacer 24 between the core 21 and the secondary magnetic path member 27 (the base member 271). The coupling member 272 magnetically couples the projecting parts 271*b* of the base member 271 so as to form a closed magnetic path as the secondary magnetic path. Thus, the antenna 8 is manufactured.

The manufactured antenna 8 is housed in the antenna case 4, and the antenna case 4 and the watch case 6 in which the watch main body 5 is housed are connected to each other so that the antenna 8 and the circuit board and the like in the watch main body 5 are electrically connected to each other.

Further, the band pieces 7 are connected to the antenna case 4 and the watch case 6, whereby the bracelet type radio controlled watch is manufactured.

The other points are the same as those in the first embodiment, and hence description thereof is omitted.

As described above, according to the second embodiment, in addition to the advantageous effects obtained by the first embodiment, the following advantageous effects can be obtained.

In the second embodiment, the secondary magnetic path member 27 includes: (i) the U-shaped base member 271 including (a) the linear part 271*a* and (b) the pair of projecting parts 271*b* which project from the linear part 271*a* in one direction; and (ii) the coupling member 272 which magnetically couples the projecting parts 271*b* of the base member 271 so as to form a closed magnetic path as the secondary magnetic path.

Accordingly, as compared with the case where a secondary magnetic path member is bended or the like so as to be magnetically coupled, namely, so as to form a secondary magnetic path (closed magnetic path), the secondary magnetic path member 27 can easily form a secondary magnetic path.

Further, as compared with the case where a secondary magnetic path member is made of a flexible material, the rigidity of the antenna 8 can be higher.

In the above, the embodiments of the present invention are described. However, the present invention is not limited to the embodiments. Needless to say, the present invention can be variously modified without departing from the scope of the present invention.

For example, in the embodiments, one spacer and one secondary magnetic path member are provided. However, two or more spacers and/or two or more secondary magnetic path members may be provided.

Figure 13:
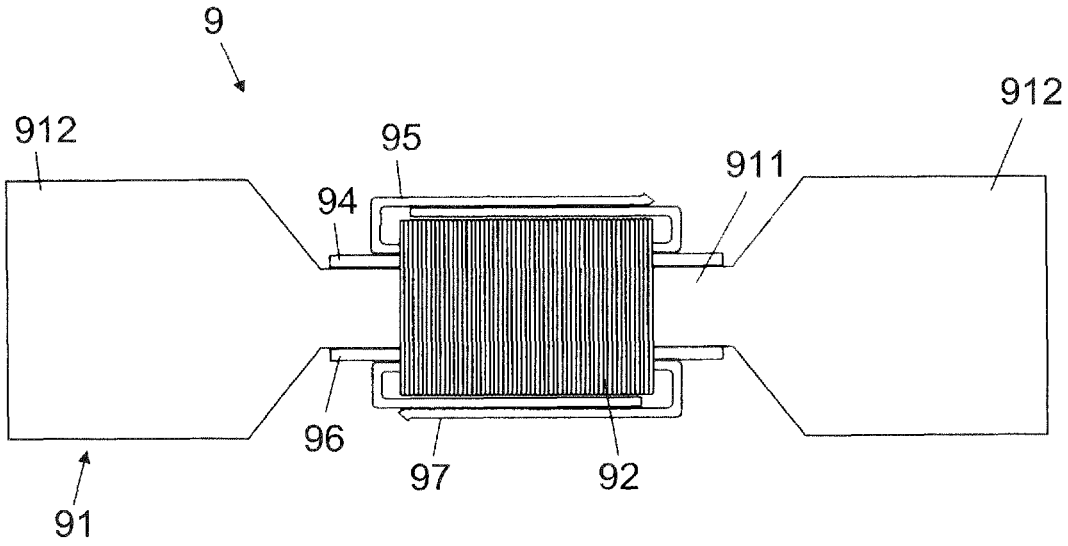
FIG. 13 is a plan view of an antenna modified from the antenna shown in FIG. 2.

For example, as shown in FIG. 13, an antenna 9 includes: a core 91 including a linear part 911 and a pair of protruding parts 912 respectively disposed on the ends (lateral ends) of the linear part 911; spacers 94 and 96 respectively disposed on the sides of the linear part 911; and secondary magnetic path members 95 and 97 respectively disposed parallel to the sides of the linear part 911 with the spacer 94 between the core 91 and the secondary magnetic path member 95 and with the spacer 96 between the core 91 and the secondary magnetic path member 97. A coil 92 is formed by winding a wire around the linear part 911 of the core 91 in such a way as to bundle the core 91, the spacers 94 and 96, and the secondary magnetic path members 95 and 97 together.

Consequently, two looped secondary magnetic paths are formed on the sides of the linear part 911. Accordingly, leakage of magnetic flux can be more certainly prevented.

The number of spacers, the number of secondary magnetic path members, and positions of the spacers and the secondary magnetic path members are not particularly limited. For example, spacers and secondary magnetic path members may be disposed on three or four sides (positions) so as to enclose a linear part of a core.

Further, it is unnecessary that one spacer is paired with one secondary magnetic path member. For example, it is possible that one spacer is disposed in such a way as to wind around a linear part of a core, and a plurality of secondary magnetic path members is disposed around the linear part of the core with the one spacer between the core and the secondary magnetic path members.

Further, in the embodiments, an antenna is housed in the small antenna case 4 having a small space between the antenna and the inner surface of the antenna case 4. However, the size, shape and the like of the antenna case 4 are not limited to those exemplified herein.

For example, the antenna case 4 may be configured to be somewhat large so as to have a large space between the antenna and an inner lateral face of the antenna case 4.

In this case, it is preferable that the antenna is disposed in the antenna case 4 in such a way as to have a larger space on the side of the antenna, the side where a coil is disposed.

Further, in the embodiments, each of the antenna case 4, the watch case 6, and the band pieces 7 is formed in the shape of a quadrilateral two-dimensionally. However, the shape of the antenna case 4, the watch case 6, and the band pieces 7 is not limited thereto. For example, the shape thereof may be a round or a polygon two-dimensionally.

Further, in the embodiments, the antenna case 4, the watch case 6, and the band pieces 7 are almost the same in shape and size. However, the antenna case 4, the watch case 6, and the band pieces 7 may be different in shape and size.

For example, the watch case 6 may be larger than the antenna case 4 and the band pieces 7.

Further, the shape, size and the like of the core, the spacer, and the secondary magnetic path member are not limited to those exemplified herein, and hence can be appropriately changed in accordance with the shape or the like of the antenna case 4 in which the antenna is housed.

Further, in the embodiments, the antenna case 4 in which the antenna is housed and the watch case 6 in which the watch main body 5 is housed are separately provided, and the antenna and the watch main body 5 are housed in the antenna case 4 and the watch case 6, respectively. However, the antenna and the watch main body 5 may be housed in one case (i.e. a same case).

In this case, for example, by disposing the antenna on the circuit board of the watch main body 5 or the like, the antenna and the circuit board can be easily electrically connected to each other.

Further, in the embodiments, as a radio receiver to which the antenna is applied, the bracelet type radio controlled watch is described. However, it is unnecessary that the radio controlled watch is a bracelet type, and may be a pendant type, for example.

Further, as described above, in the embodiments, as a radio receiver to which the antenna is applied, the radio controlled watch is described. However, the radio receiver to which the antenna is applied is not limited thereto, and can be any radio receiver configured to receive radio waves with an antenna.

In the above, several embodiments of the present invention are described. However, the scope of the present invention is not limited to the embodiments, and includes the scope of claims attached below and equivalences thereof.

This application is based upon and claims the benefit of priority under 35 USC 119 of Japanese Patent Application No. 2011-252158 filed on Nov. 18, 2011, the entire disclosure of which, including the description, claims, drawings, and abstract, is incorporated herein by reference in its entirety.

What is claimed is:

1. An antenna comprising:

an elongated magnetic core;

a secondary magnetic path member disposed near the core, and forming a secondary magnetic path;

a spacer disposed between the core and the secondary magnetic path member so as to prevent the core and the secondary magnetic path member from being magnetically coupled; and a coil formed by winding a wire around the core so as to bundle the core and the secondary magnetic path member together, wherein the secondary magnetic path member comprises a thin plate disposed parallel to the core with the spacer provided therebetween, and wherein ends of the secondary magnetic path member are magnetically coupled so as to form a closed magnetic path as the secondary magnetic path, whereby the secondary magnetic path member is disposed so as to enclose the coil and forms a looped magnetic path which allows magnetic flux from the coil to circle.

2. An antenna comprising:

an elongated magnetic core;

a secondary magnetic path member disposed near the core, and forming a secondary magnetic path;

a spacer disposed between the core and the secondary magnetic path member so as to prevent the core and the secondary magnetic path member from being magnetically coupled; and a coil formed by winding a wire around the core so as to bundle the core and the secondary magnetic path member together, wherein the secondary magnetic path member includes:

a U-shaped base member including:

a linear part disposed parallel to the core with the spacer in between; and a pair of projecting parts projecting from the linear part in one direction; and a coupling member magnetically coupling the pair of projecting parts so as to form a closed magnetic path as the secondary magnetic path, whereby the secondary magnetic path member is disposed so as to enclose the coil and forms a looped magnetic path which allows magnetic flux from the coil to circle.

3. A radio receiver comprising:

an antenna including:

an elongated magnetic core;

a secondary magnetic path member disposed near the core, and forming a secondary magnetic path;

a spacer disposed between the core and the secondary magnetic path member so as to prevent the core and the secondary magnetic path member from being magnetically coupled; and a coil formed by winding a wire around the core so as to bundle the core and the secondary magnetic path member together; and a metallic antenna case in which the antenna is housed, wherein the secondary magnetic path member comprises a thin plate disposed parallel to the core with the spacer therebetween, and wherein ends of the secondary magnetic path member are magnetically coupled so as to form a closed magnetic path as the secondary magnetic path, whereby the secondary magnetic path member is disposed so as to enclose the coil and forms a looped magnetic path which allows magnetic flux from the coil to circle.

4. A method for manufacturing an antenna comprising:

forming an elongated magnetic core;

forming a coil by winding a wire around the core so as to bundle the core and a secondary magnetic path member together, the secondary magnetic path member forming a secondary magnetic path, in a state in which the secondary magnetic path member is disposed near the core with a spacer disposed between the core and the secondary magnetic path member so as to prevent the core and the secondary magnetic path member from being magnetically coupled; and magnetically coupling ends of the secondary magnetic path member so as to form a closed magnetic path as the secondary magnetic path, the secondary magnetic path member comprising a thin plate disposed parallel to the core with the spacer provided therebetween, whereby the secondary magnetic path member is disposed so as to enclose the coil and forms a looped magnetic path which allows magnetic flux from the coil to circle.

* * * * *